US008083426B2

(12) United States Patent
Wu

(10) Patent No.: US 8,083,426 B2
(45) Date of Patent: Dec. 27, 2011

(54) LIQUID DISPENSER

(76) Inventor: Shang Chuan Wu, Chang-Hwa (TW)

( * ) Notice: Subject to any disclaimer, the term of this patent is extended or adjusted under 35 U.S.C. 154(b) by 357 days.

(21) Appl. No.: 12/584,361

(22) Filed: Sep. 3, 2009

(65) Prior Publication Data

US 2011/0052308 A1 Mar. 3, 2011

(51) Int. Cl.
*A46B 11/02* (2006.01)

(52) U.S. Cl. ..... 401/188 R

(58) Field of Classification Search ..... 401/187, 401/188 R, 188 A, 189
See application file for complete search history.

(56) References Cited

U.S. PATENT DOCUMENTS 1,857,857 A * 5/1932 Medley ..... 401/176
1,901,971 A * 3/1933 Iorio ..... 401/189
4,722,459 A * 2/1988 Goncalves ..... 222/135
6,896,433 B1 5/2005 Zhang et al.
7,175,359 B2 2/2007 Zhang et al.

* cited by examiner

*Primary Examiner* — Huyen Le
(74) *Attorney, Agent, or Firm* — Charles E. Baxley

(57) ABSTRACT

A liquid dispenser includes a hollow shank, a dispensing device longitudinally mounted to a first end of the hollow shank, a control device longitudinally mounted to a second end of the hollow shank and a sheath detachably mounted to the first end of the hollow shank for protecting the dispensing head after use. A passage is defined in the control device and communicating with an inner periphery of the hollow shank and the dispensing device such that the liquid contained in the hollow shank can flow into the dispensing device when the passage is opened. The control device is provided to selectively close/open the passage for controlling the output quantity of the liquid dispenser.

20 Claims, 10 Drawing Sheets

LIQUID DISPENSER

BACKGROUND OF THE INVENTION

1. Field of the Invention

The present invention relates to a liquid dispenser, and more particularly to a liquid dispenser that outputs liquid in a fixed quality for every operation.

2. Description of Related Art

A conventional cosmeticizing pen, U.S. Pat. No. 6,896,433, includes a sleeve and a guider partially received in the sleeve, a first cylinder and a second cylinder respectively longitudinally mounted to two opposite ends of the guider for containing two different cosmetics. A first head and a second are respectively mounted to a free end of each of the first cylinder and the second cylinder. A first cap and a second cap are respectively mounted to the first head and the second head for protect the first head and the second head after use. A first drive set and a second drive set respectively mounted in the first cylinder and the second cylinder. There are multiple threaded elements disposed in the conventional cosmeticizing pen for squeezing and outputting the cosmetic in the first/second cylinder.

However, the output quality of the conventional liquid dispenser is unfixed because the user can not precisely control the moving rate of the threaded elements every time when squeezing and outputting the cosmetic in the first/second cylinder. As a result, the output liquid either be insufficient or be wasted. It needs to be advantageously altered.

The present invention has arisen to mitigate and/or obviate the disadvantages of the conventional cosmeticizing pen.

SUMMARY OF THE INVENTION

The main objective of the present invention is to provide an improved liquid dispenser that outputs liquid in a fixed quality for every operation.

To achieve the objective, the liquid dispenser in accordance with the present invention comprises a hollow shank for containing liquid. The hollow shank has a closed first end and a open second end. A first tapered hole is centrally defined in the first end of the hollow shank and communicates with an inner periphery of the hollow shank.

A dispensing device is longitudinally mounted to the first end of the hollow shank. The dispensing device includes a positioning ring longitudinally mounted to the first end of the hollow shank and having multiple ribs longitudinally formed on an inner periphery thereof. The positioning ring includes a distal end, opposite to the hollow shank, having a shoulder inward extending therefrom. A series of indentations with different heights are defined in the shoulder between every two adjacent ribs. An adjuster extends through the positioning ring and is engaged to the shoulder. The adjuster is rotatable relative to the positioning ring and the rotating radian of the adjuster is equal to that between every two adjacent ribs. The adjuster is reciprocally and longitudinally moved relative to the hollow shank when being rotated. A hole is centrally defined in the adjuster. A first cone centrally extends from a bottom of the hole for selectively closing the first tapered hole. A skirt extends from the bottom of the hole and surrounds the first cone to define an annular groove. Multiple channels are defined in a bottom of the annular groove and communicating with a recess that is defined in a bottom of the adjuster. The adjuster has multiple ears outwardly extending therefrom. Each ear is engaged with a corresponding one of the multiple series of indentations. A holder extends through the positioning ring and is longitudinally mounted to the adjuster. A through hole is centrally defined in the holder. A dispensing element extends through the through hole in the holder and is mounted on the holder for dispensing the liquid from the hollow shank.

A control device is longitudinally mounted to the second end of the hollow shank for allowing the air flow into the hollow shank step by step and the dispensing element outputs the liquid when the air flows into the hollow shank.

A sheath is longitudinally mounted to the first end of the hollow shank for protecting the dispensing device after use. The sheath has a hollow rod extending therefrom along an axis thereof for receiving the dispensing element. A free end of the hollow rod of the sheath longitudinally pushes the holder with the adjuster for forcing the first cone to close the first tapered hole when mounting the sheath.

Further benefits and advantages of the present invention will become apparent after a careful reading of the detailed description with appropriate reference to the accompanying drawings.

DETAILED DESCRIPTION OF THE INVENTION

Figure 1:
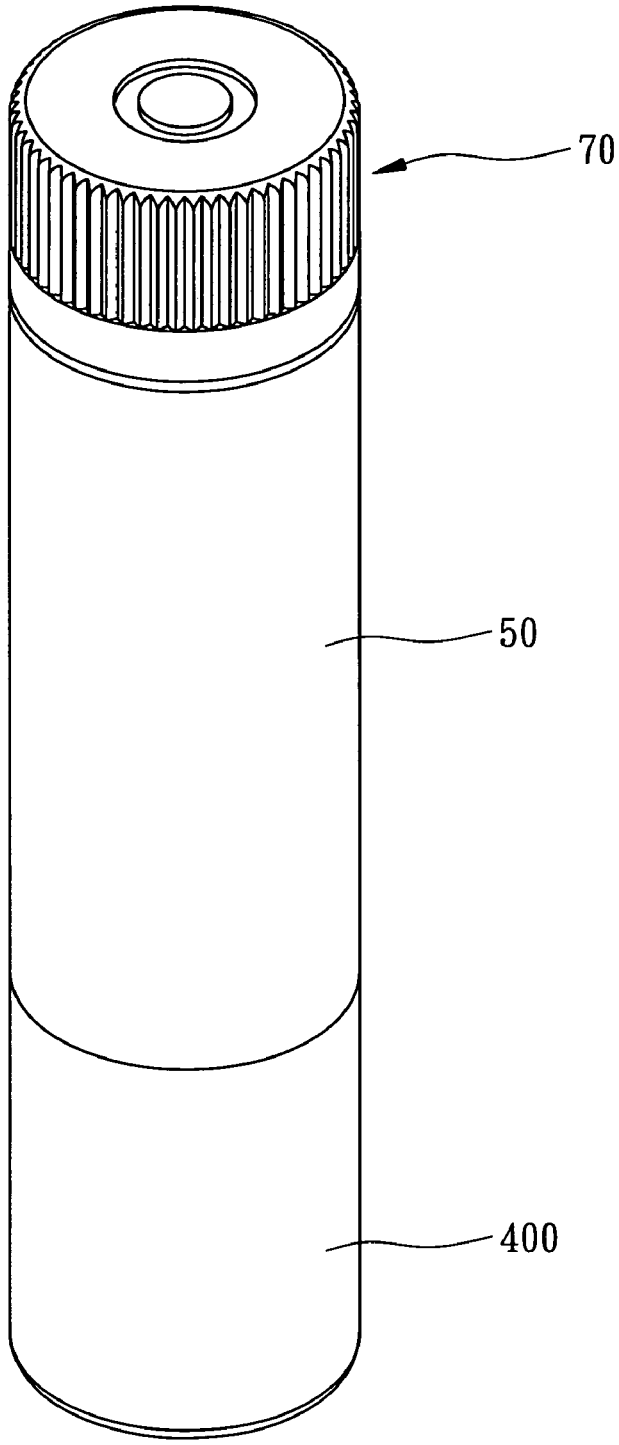
FIG. 1 is a perspective view of a liquid dispenser in accordance with the present invention.
Figure 2:
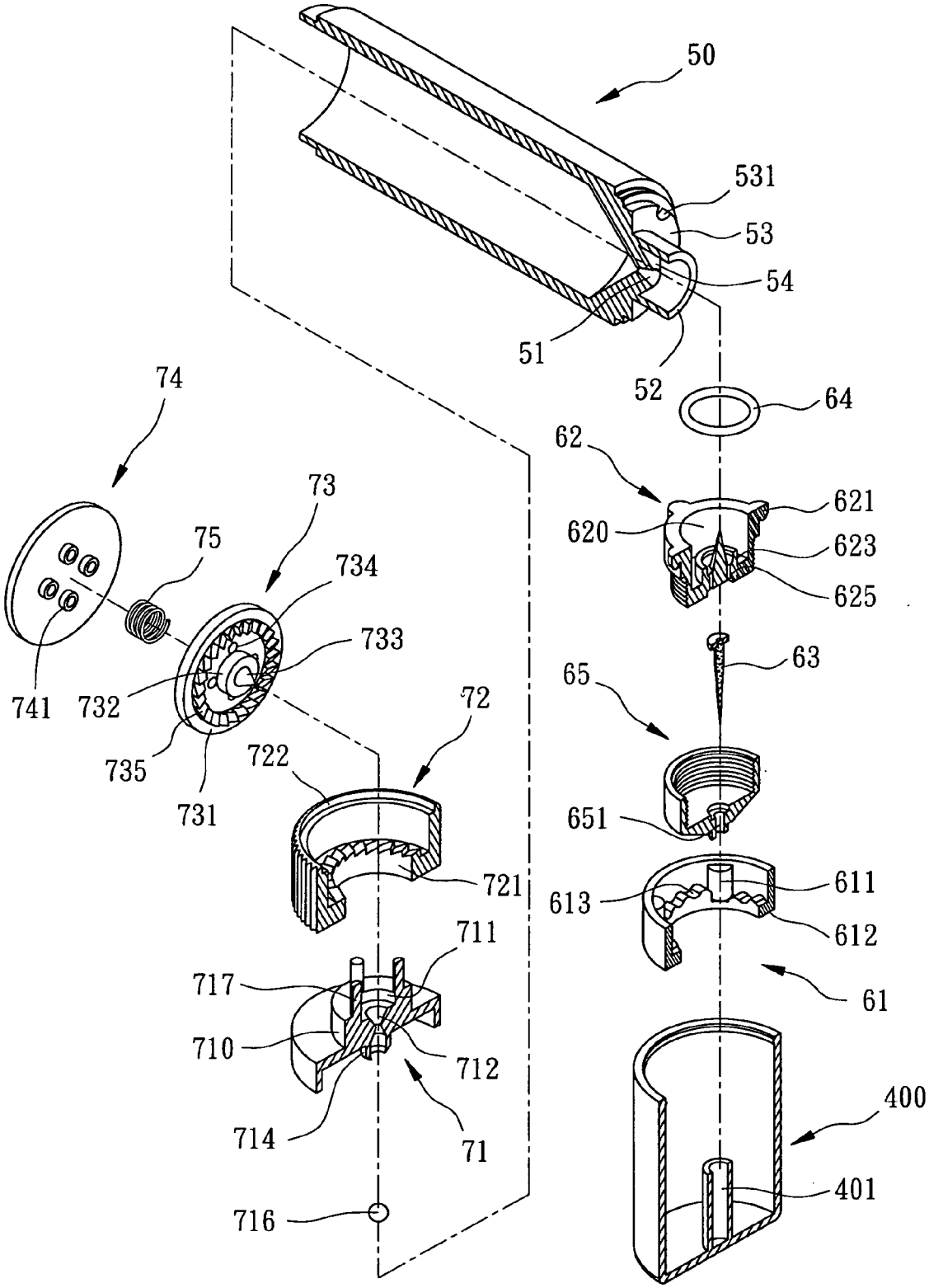
FIG. 2 is an exploded perspective view of the liquid dispenser in FIG. 1.
Figure 3:
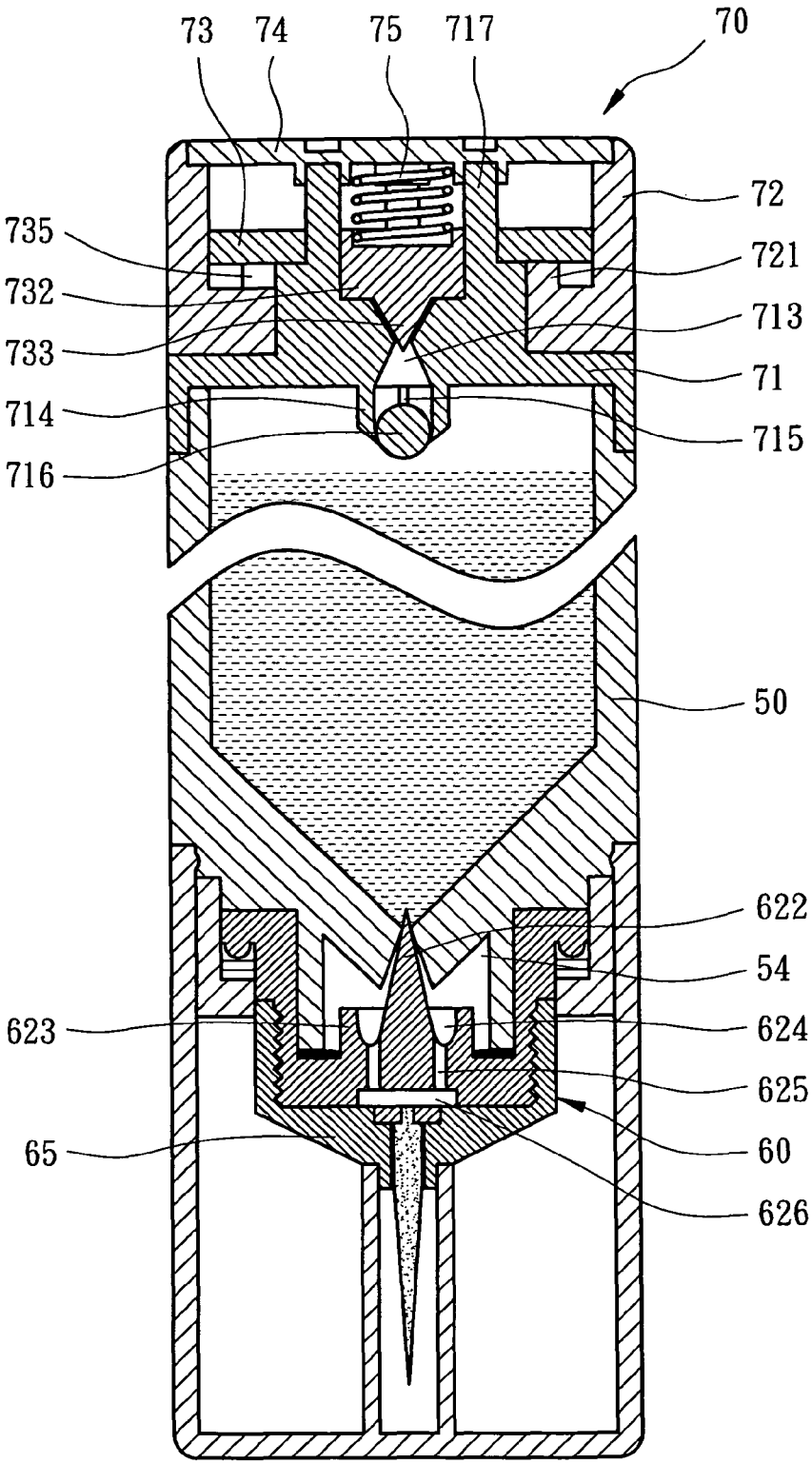
FIG. 3 is a cross-sectional view of the liquid dispenser in FIG. 1.

Referring to the drawings and initially to FIGS. 1-3, a liquid dispenser in accordance with the present invention comprises a hollow shank (50), a dispensing device (60) longitudinally mounted to a first end of the hollow shank (50), a control device (70) longitudinally mounted to a second end of the hollow shank (50) and a sheath (400) longitudinally mounted to the first end of the hollow shank (50) for protecting the dispensing device (60) after use.

The first end of the hollow shank (50) is closed and the second end of the hollow shank (50) is open. A first tapered hole (51) is centrally defined in the first end of the hollow shank (50) and communicates with an inner periphery of the hollow shank (50). A protrusion (53) co-axially extends form the first end of the hollow shank (50) and has multiple cutouts (531) defined in and equally dividing the protrusion (53). In the preferred embodiment of the present invention, there are fourth cutouts (531) defined in the periphery of the protrusion (53). A hollow stub (52) co-axially extends from the protrusion (53). A V-shaped groove is defined in the protrusion (53) within the hollow stub (52) and surrounding the first tapered hole (15).

The dispensing device (60) includes a positioning ring (61) longitudinally mounted to the protrusion (53). The positioning ring (61) has multiple ribs (611) longitudinally formed on an inner periphery thereof. Each rib (61) is partially received in a corresponding one of the multiple cutouts (531) such that the positioning ring (61) can not be rotatable relative to the hollow shank (50). The positioning ring (61) includes a distal end, opposite to the hollow shank (50), having a shoulder (612) inward extending therefrom. A series of indentations (613) with different heights is defined in the shoulder (612) between every two adjacent ribs (611).

An adjuster (62) extends through the positioning ring (61) and is engaged to the shoulder (612) of the positioning ring (61). The adjuster (62) is rotatable relative to the positioning ring (61) and the rotating radian of the adjuster (62) is the radian between every two adjacent ribs (611). In addition, the adjuster (62) is reciprocally and longitudinally moved relative to the hollow shank (50) when being rotated. A hole (620) is centrally defined in the adjuster (62) for rotatably receiving the hollow stub (52) for stably rotating the adjuster (62). A first cone (622) centrally extends from a bottom of the hole (620). The first cone (622) is selectively received in the first tapered hole (51) for closing the first tattered hole (51). A skirt (623) extends from the bottom of the hole (620) and surrounds the first cone (622) to define an annular groove (624). Multiple channels (625) are longitudinally defined in a bottom of the annular groove (624) and extending through the adjuster (62). A recess (626) is defined in a distal end of the adjuster (62) and communicates with the multiple channels (625). The adjuster (62) has multiple ears (621) outwardly extending therefrom and equally dividing an outer periphery thereof. Each ear (621) is engaged with a corresponding one of the multiple series of indentations (613).

A holder (65) extends through the positioning ring (61) and is longitudinally mounted to the adjuster (62). A through hole (651) is centrally defined in the holder (65). A dispensing element (63) extends through the through hole (651) and mounted on the holder (65) for dispensing the liquid from the hollow shank (50). The dispensing element (63) is a writing brush or made of foam material relative to the liquid in the hollow shank (50). A sealant (64) is disposed on the bottom of the hole (620) for providing an anti-permeate effect when being compressed by the distal end of the hollow stub (52).

The control device (70) includes a guider (71) co-axially and detachably mounted to the second end of the hollow shank (50), and airtightly closing the second end of the hollow shank (50). The guider (71) has a protrusion (710) centrally extending therefrom opposite to the hollow shank (50). A recess (711) is centrally defined in the protrusion (710) of the guider (71) and a second tapered hole (712) is centrally defined in a bottom of the recess (711) in the guider (71). A third tapered hole (713) is centrally defined in the guider (71) and longitudinally communicates with the second tapered hole (712) to define a sandglass-shaped passage in the guider (71). A hollow protrusion (714) extends from the guider (71) and surrounds the third tapered hole (713). A distal end of the hollow protrusion (714) is slightly and inwardly shrunk. Multiple slots (715) are longitudinally defined in the hollow protrusion (714) and communicate with an inner periphery of the hollow protrusion (714). A steel ball (716) is movably received in the hollow protrusion (714). The steel ball (716) has a diameter greater than an inner diameter of the distal end of the hollow protrusion (714) to prevent the steel ball (716) from detaching from the hollow protrusion (714). Multiple guide rods (717) perpendicularly extend from the protrusion (710) of the guider (71).

A drive ring (72) is rotatably sleeved on the protrusion (710) of the guider (71). A first ratchet ring (721) inward and radially extends from an inner periphery of the drive ring (72) and surrounds the protrusion (710) of the guider (71). One end of drive ring (72) opposite to the hollow shank (50) has an annular groove (722) defined therein.

A pusher (73) is longitudinally mounted to the guider (71). The pusher (73) has a disk (731) co-axially received in the drive ring (72) and the drive ring (72) is rotatable relative to the disk (731). A block (732) centrally extends from the disk (731) and a movably received in the recess (711) in the guider (71). A second cone (733) centrally extends from the block (732) and is selectively received in the second tapered hole (712) for closing the second tapered hole (712). The disk (731) includes multiple through holes (734) defined therein. Each through hole (7314) in the disk (731) aligns with a corresponding one of the multiple guide rods (717) for allowing the multiple guide rods (717) extending through the disk (731) such that the disk (731) is not rotatable relative to the guider (71) and only can be reciprocally moved relative to the guider (71). A second ratchet ring (735) is formed on the disk (731) and complementally engaged to the first ratchet ring (721).

A cover (74) is secured to a free end of each of the multiple guide rods (717) and received in the annular groove (722) in the drive ring (72) to prevent the drive ring (72) and the pusher (73) from detaching from the guider (71). The cover (74) has multiple hollow stub (741) extending therefrom. Each hollow stub (741) receives a free end of a corresponding one of the multiple guide rods (717).

A resilient member (75) is pre-compressively mounted between the disk and the cover (74). The resilient member (75) ensures that the first ratchet ring (721) and the second ratchet ring (735) are complementally engaged with each other, and the second cone (733) is received in the second tapered hole (712) for closing the second tapered hole (712) before the drive ring (72) being rotated. In the preferred embodiment of the present invention, the resilient member (75) is a compression spring.

The sheath (400) has a hollow rod (401) extending therefrom along an axis thereof for receiving the dispensing element (63) when the sheath (400) is longitudinally mounted to the first end of the hollow shank (50). A free end of the hollow rod (401) longitudinally pushes the holder (65) with the adjuster (62) for forcing the first cone (622) to close the first tapered hole (51) when the sheath (400) is longitudinally mounted to the first end of the hollow shank (50) after use.

Figure 4:
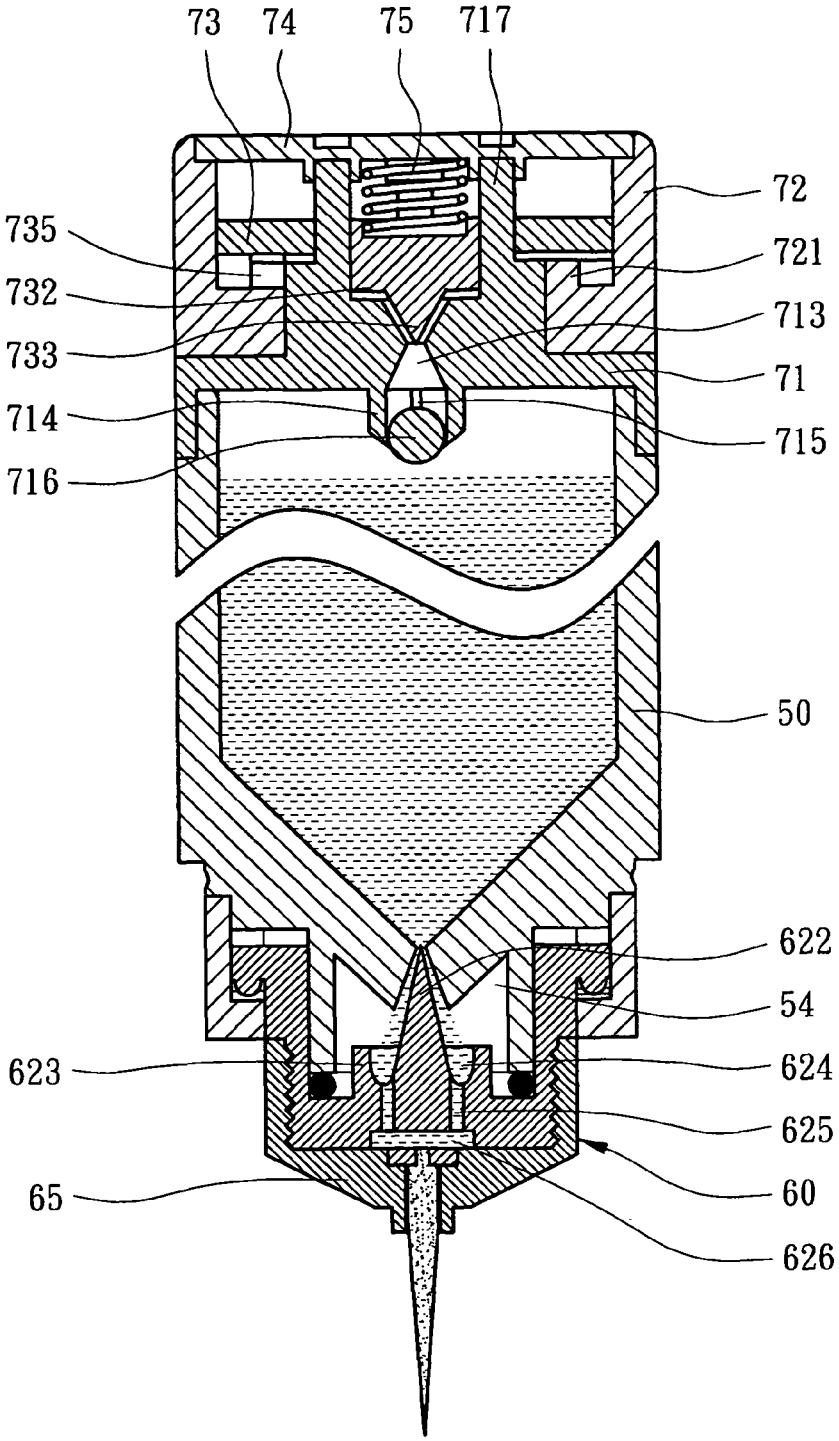
FIG. 4 is an operational view of the liquid dispenser in FIG. 1 when the sheath is detached from the hollow shank.

With reference to FIG. 4, when operating the liquid dispenser in accordance with the present invention, the sheath (400) is detached from the first end of the hollow shank (50) and the adjuster (62) is rotated relative to the positioning ring (61) to make the first cone (6221) being separated from the first tapered hole (51). The liquid in the hollow shank (50) is temporarily held in the hollow shank (50) before the control device (70) being operated because the second tapered hole (712) is closed by the second cone (733) and the air can not flows into the hollow shank (50). The disk (713) is pushed and moved toward the cover (74) to compress the resilient member (75) due to the engaged first ratchet ring (721) and the second ratchet ring (735) when the drive ring (72) is rotated relative to the ratchet direction of the first ratchet ring (721). At the same time, the second cone (733) is separated from the second tapered hole (712) such that the air can flows into the hollow shank (50) sequentially via the recess (711) in the guider (71), the second tapered hole (712), the third tapered hole (713) and the slots (715), and the liquid, in the hollow shank (50), flows into the dispensing element (63) sequentially via the first tapered hole (51), annular groove (624), the channels (625) and the recess (626) in the adjuster (62). The first ratchet ring (721) and the second ratchet ring (735) are complementally engaged with each other and the second cone (733) closed the second tapered hole (712) again due to the restitution force of the resilient member (75) when the drive ring (72) is rotated over a pitch of the ratchets formed thereon. Consequently, the liquid dispenser in accordance with the present invention can dispense liquid step by step and in a purposed quantity for every operation.

In addition, the gap between the first cone (622) and the first tapered hole (51) can be adjusted by rotating the holder (65) with the adjuster (62) to adjust the relative distance between the first end of the hollow shank (50) and the adjuster such that the purposed quantity is adjusted. Consequently, the first tapered hole (51) is closed by the first cone (622) when the distance between the first end of the hollow shank (50) and the adjuster (62) is adjusted to a minimum.

Figure 5:
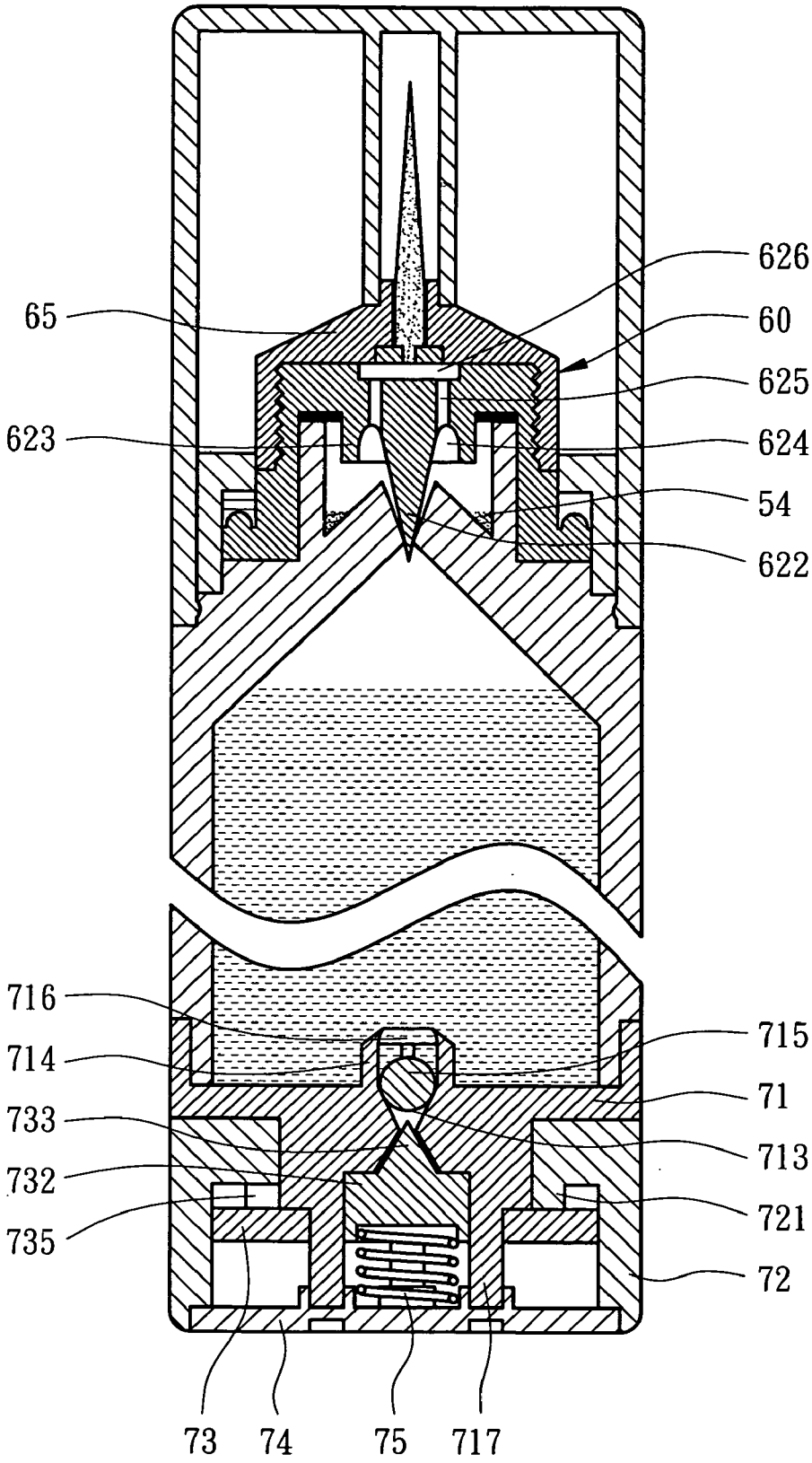
FIG. 5 is another operational view of the liquid dispenser in FIG. 1 when the liquid dispenser is reversed.

With reference to FIG. 5, the steel ball (716) abuts against an inner periphery of the third tapered hole (713) for closing the third tapered hole (713) when the hollow shank (50) is reversed and the control device (70) is operated in error such that the liquid would not flow out of the hollow shank (50) even the air flows into the hollow shank (50). In addition, the remained liquid in the adjuster (62) flows into the V-shaped groove (54) and the first tapered hole (51) is closed by the first cone (622) when the sheath (400) is longitudinally mounted to the first end of the hollow shank (50).

Furthermore, the guider (71) is detachably mounted to the second end of the hollow shank (50) such that guider (71) with the drive ring (72), the pusher (73) and the cover (74) can be detached from the second end of the hollow shank (50) for filling liquid into the hollow shank (50).

Figure 6:
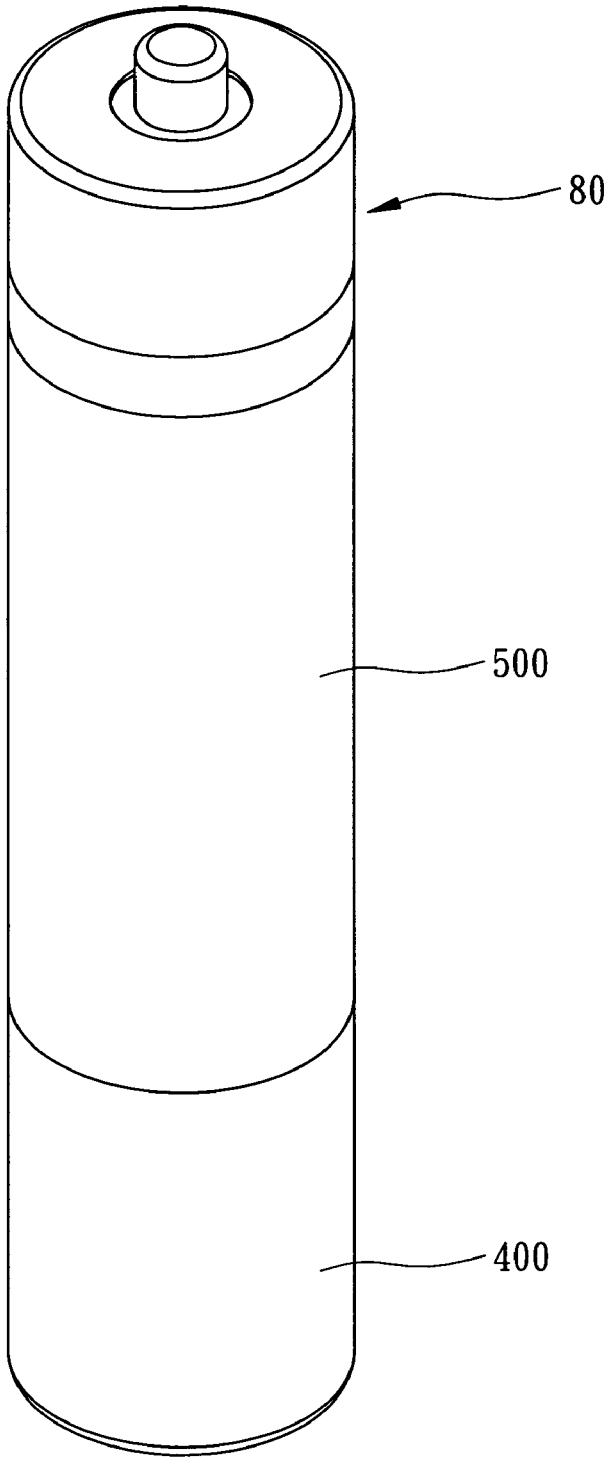
FIG. 6 is a perspective view of a second embodiment of the liquid dispenser in accordance with the present invention.
Figure 7:
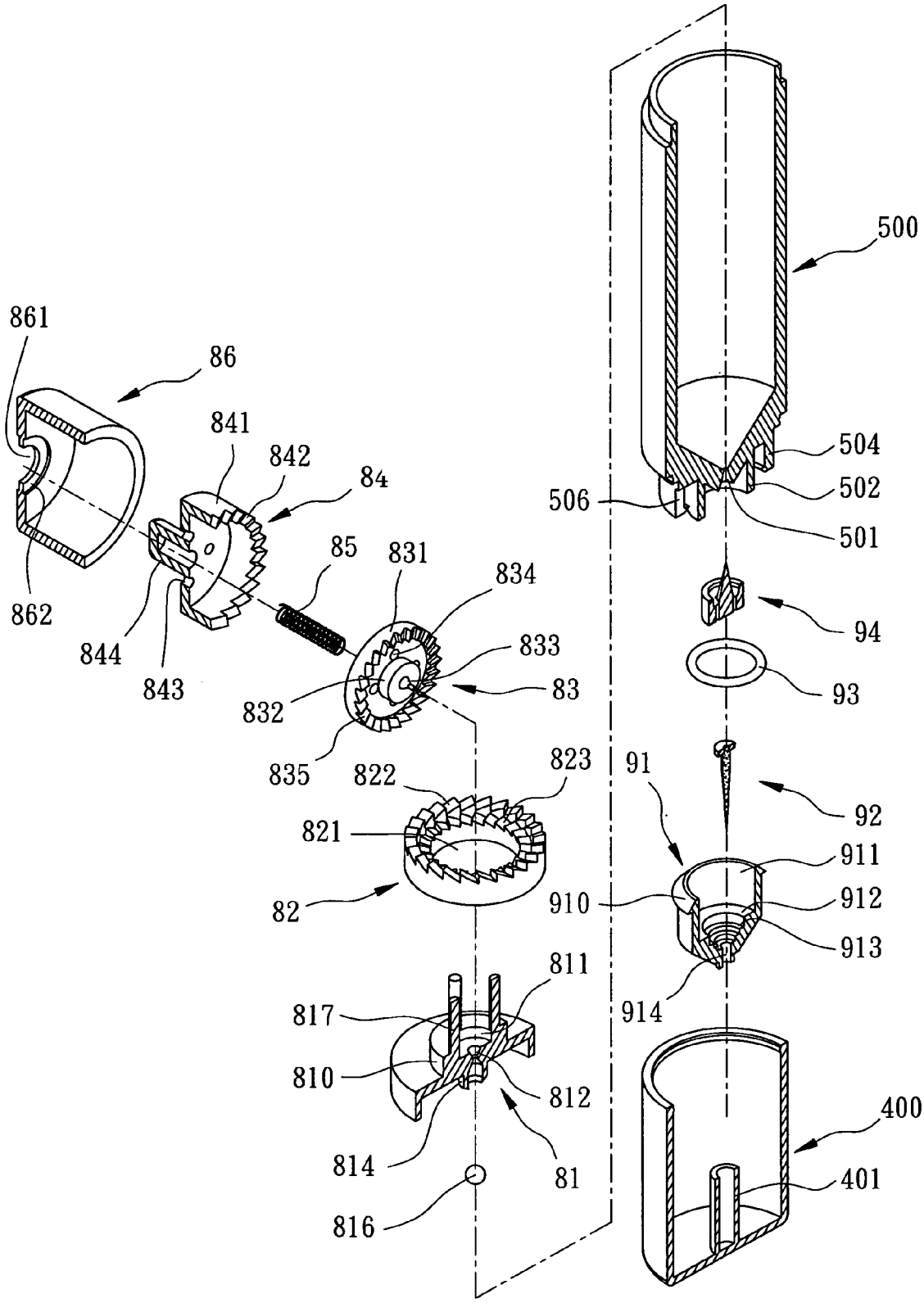
FIG. 7 is an exploded perspective view of the liquid dispenser in FIG. 6.
Figure 8:
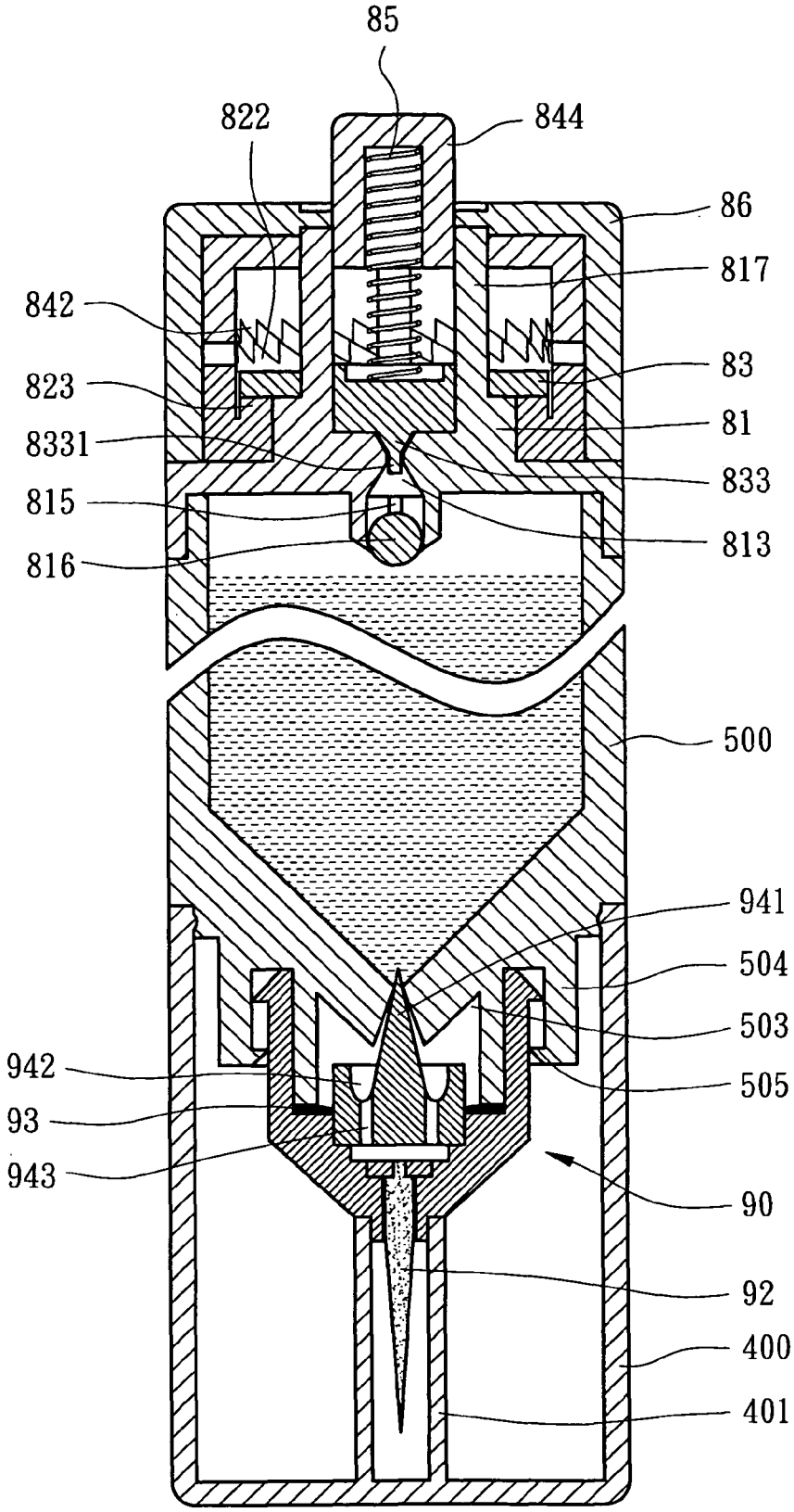
FIG. 8 is a cross-sectional view of the liquid dispenser in FIG. 6.

With reference to FIGS. 6-8 that show a second embodiment of the liquid dispenser in accordance with the present invention, in this embodiment, the liquid dispenser comprises a hollow shank (500), a dispensing device (90) longitudinally mounted to a first end of the hollow shank (500), a control device (80) mounted to a second end of the hollow shank (500).

The first end of the hollow shank (500) is closed and the second of the second end of the hollow shank (500) is open. A first tapered hole (501) is centrally defined in the first end of the hollow shank (500) and communicates with an inner periphery of the hollow shank (500). A first skirt (502) co-axially extends from the first end of the hollow shank (500) and surrounds the first tapered hole (501). A V-shaped groove (503) is defined in the first end of the hollow shank (500) between the first tapered hole (501) and the first skirt (502). A second skirt (504) co-axially extends from the first end of the hollow shank (500) and surrounds the first skirt (502). A first annular hook (505) is inward formed on a free end of the second skirt (504) and multiple slots (506) is longitudinally defined in the second skirt (504).

The dispensing device (90) includes a holder (91) engaged to the second skirt (504) and reciprocally moved relative to the first end of the hollow shank (500). The holder (91) has a second annular hook (910) outwardly extending from a first end thereof. The first annular hook (505) and the second annular hook (910) are engaged to each other for preventing the holder (91) from detaching from the hollow shank (500), and the slots (506) in the second skirt (504) are provided for easily mounting the holder (91). A receiving space (911) is centrally defined in the holder (91) for movably receiving the first skirt (502) for promoting the steadiness when the holder (91) is moved along the first skirt (502). A first shoulder (912) and a second shoulder (913) are sequentially and centrally formed on a bottom of the receiving space (911), wherein the first shoulder (912) has a diameter greater than that of the second shoulder (913). A through hole (914) is centrally defined in a second end of the holder (91). A dispensing element (92) extends through the through hole (914) and mounted in the second end of the holder (91). The dispensing element (92) is a writing brush or made of foam material relative to the liquid in the hollow shank (500). A sealant (93) is disposed on the first shoulder (912) for providing an anti-permeate effect when being compressed by the distal end of the first skirt (502).

A dispensing block (94) is received in the holder (91) and mounted on the second shoulder (913). The dispensing block (94) has a first cone (941) centrally extending therefrom for selectively closing the first tapered hole (501), and an annular groove (942) defined therein and surrounding the first cone (941). Multiple channels (943) are defined in a bottom of the annular groove (942). Each channel (943) extends through the dispensing block (94) and communicates with the through hole (914) in the holder (91).

Figure 9:
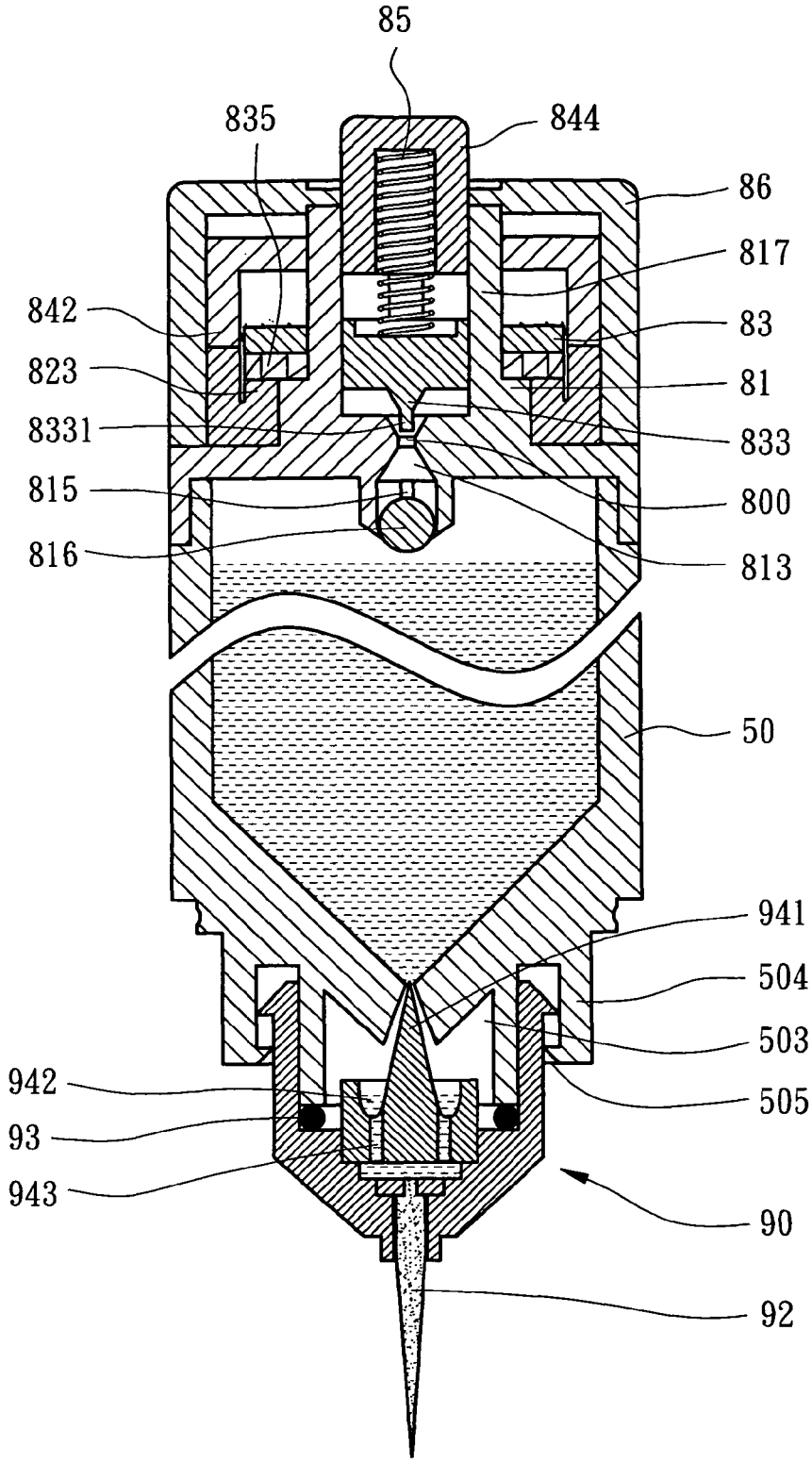
FIG. 9 is an operational view of the liquid dispenser in FIG. 6 when the sheath is detached from the hollow shank.

The control device (80) includes a guider (81) co-axially mounted to the second end of the hollow shank (500) and airtightly closing the second end of the hollow shank (500). The guider (81) has a protrusion (810) centrally extending therefrom opposite to the hollow shank (500). A recess (811) is centrally defined in the protrusion (810) and a second tapered hole (812) is centrally defined in a bottom of the recess (811). A third tapered hole (813) is defined in the guider (81) and a passage (800) is centrally defined in the guider (81). The passage (800) has two opposite ends respectively communicating with the second tapered hole (812) and the third tapered hole (813), as shown in FIG. 9. A hollow protrusion (814) extends from the guider (81) and surrounds the third tapered hole (813). A distal end of the hollow protrusion (814) is slightly and inwardly shrunk. Multiple slots (815) are longitudinally defined in the hollow protrusion (814) and communicate with an inner periphery of the hollow protrusion (814). A steel ball (816) is received in the hollow protrusion (814). The steel ball (816) has a diameter greater than an inner diameter of the distal end of the hollow protrusion (814) to prevent the steel ball (816) from detaching from the hollow protrusion (814). Multiple guide rods (817) perpendicularly extend from the protrusion (810) of the guider (81).

An actuator (82) is rotatably mounted on the guider (81). The actuator (82) has a central hole (821) defined therein for receiving the protrusion (810). The actuator (82) includes an outer ratchet ring (822) and an inner ratchet ring (823) respectively formed on one side thereof opposite to the guider (81), wherein the ratchet direction of the outer ratchet ring (822) is opposite to that of the inner ratchet ring (823).

A pusher (83) is longitudinally mounted to the actuator (82). The pusher (83) has a disk (831) rotatably and partially received in the actuator (82). A block (832) centrally extends from the disk (831) and is movably received in the recess (811) in the guider (81). A second cone (833) centrally extends from the block (832) and selectively received in the second tapered hole (812) for closing the second tapered hole (812). A heel (8331) longitudinally extends from a top of the second cone (833) and selectively received in the passage (800) for blocking the passage (800). The disk (831) has multiple through holes (834) defined therein and surrounding the block (832). Each through hole (834) in the disk (831) aligns with a corresponding one of the multiple guide rods (817) to allow the multiple guide rods (817) extending through the disk (831) such that the disk (831) can only be longitudinally moved relative to the guider (81). A first ratchet ring (835) is formed on one side of the disk (831) and complementally engaged with the inner ratchet ring (823).

A drive element (84) is co-axially mounted to the actuator (82). The drive element (84) includes a cylindrical portion (841) having a diameter equal to that of the outer ratchet ring (822). The cylindrical portion (841) has a closed end and an open end. A second ratchet ring (842) is formed on a distal edge of the open end of the cylindrical portion (841). The second ratchet ring (842) is overlapped relative to the outer ratchet ring (822) and complementally corresponds to the outer ratchet ring (822). The second ratchet ring (842) is separated from the outer ratchet ring (822) when the drive element (84) is in a free condition. The drive element (84) has multiple through holes (843) defined in the closed end of the cylindrical portion (841) to allow the multiple guide rods (817) of the guider (81) extending through the drive element (84) such that the drive element (84) can only be longitudinally moved relative to the guider (81). A hollow rod (844) co-axially extends from the closed end of the cylindrical portion (841). A resilient member (85) is pre-compressed and mounted between the pusher (83) and the drive element (84) to make the second ratchet ring (842) being separated from the outer ratchet ring (822) when the drive element (84) is in a free condition. In the preferred embodiment of the present invention, the resilient member (85) is a compression spring and partially received in the hollow rod (844).

A cap (86) is co-axially and securely mounted to the guider (81) for movably receiving the drive element (84). The cap (86) has a through hole (861) defined therein for allowing the hollow rod (844) extending through the cap (86). An annular groove (862) is defined in the cap (86) and surrounds the through hole (861) in the cap (86), wherein the free end of each of the multiple guide rods (817) is received in the annular groove (862) in the cap (86) when the cap (86) is mounted to the guider (81).

With reference to FIGS. 8 and 9, the drive element (84) is moved toward the actuator (82) and rotates the actuator (82) due to the complementally corresponded second ratchet ring (842) and the outer ratchet ring (822) when the hollow rod (844) is pressed. At the same time, the rotated actuator (82) pushes the pusher (83) to make the disk (831) with the second cone (833) and the heel (8331) moved toward the cap (86) and compress the resilient member (85) due to the engaged inner ratchet ring (823) and the first ratchet ring (835) such that the second cone (833) and the heel (8331) are respectively separated from the second tapered hole (812) and the passage (800). Consequently, the air flows into the hollow shank (500) via the recess (811), the second tapered hole (812) the passage (800), the third tapered hole (813) and the slots (815), sequentially. As a result, the liquid, in the hollow shank (500), flows into the holder (91) via the first tapered hole (501), the annular groove (942) in the dispensing block (94) and the channels (943) after the sheath (400) being detached from the hollow shank (500). Finally, the liquid is output by the dispensing element (92). The first ratchet (835) reversely rotates the actuator (82) with the inner ratchet ring (823) and the disk (831) moved toward the hollow shank (500) due to the restitution force of the resilient member (85) when the hollow rod (844) is release. The second tapered hole (812) and the passage (800) are closed again by the second cone (833) and the heel (8331) when the first ratchet ring (835) is complementally engaged with the inner ratchet ring (823) due to the restitution force of the resilient member (85).

Figure 10:
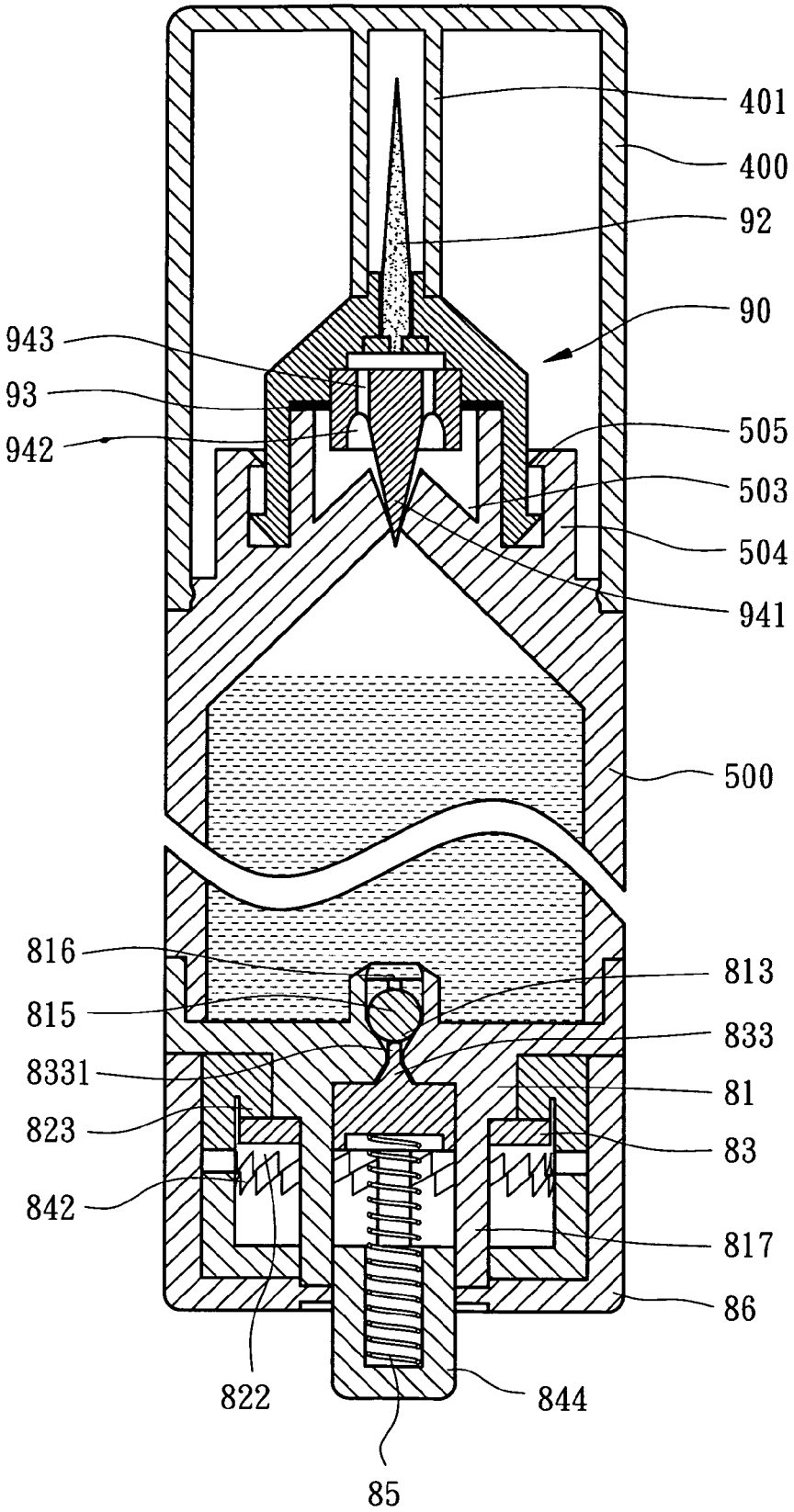
FIG. 10 is another operational view of the liquid dispenser in FIG. 6 when the liquid dispenser is reversed.

With reference to FIG. 10, the steel ball (816) abuts against an inner periphery of the third tapered hole (813) to close the third tapered hole when the hollow shank (500) is reversed and the control (80) is operated in error. Consequently, the remain liquid in the holder (91) flows into the V-shaped groove (503) and the remain liquid in the hollow shank (500) can not flow out of the hollow shank (10) via the third tapered hole (813) and the second tapered hole (812) because the third tapered hole (813) is closed. Furthermore, the first tapered hole (501) is closed by the first cone (941) when the sheath (400) is longitudinally mounted to the first end of the hollow shank (500) after use such that the air can not flow into the hollow shank (500).

Although the invention has been explained in relation to its preferred embodiment, it is to be understood that many other possible modifications and variations can be made without departing from the spirit and scope of the invention as hereinafter claimed.

What is claimed is:

1. A liquid dispenser comprising:

a hollow shank for containing liquid, the hollow shank having a closed first end and a open second end, a first tapered hole centrally defined in the first end of the hollow shank and communicating with an inner periphery of the hollow shank;

a dispensing device longitudinally mounted to the first end of the hollow shank, the dispensing device including:

a positioning ring longitudinally mounted to the first end of the hollow shank and having multiple ribs longitudinally formed on an inner periphery thereof, the positioning ring including a distal end, opposite to the hollow shank, having a shoulder inward extending therefrom, a series of indentations with different heights defined in the shoulder between every two adjacent ribs;

an adjuster extending through the positioning ring and engaged to the shoulder, the adjuster being rotatable relative to the positioning ring and the rotating radian of the adjuster equal to that between every two adjacent ribs, the adjuster reciprocally and longitudinally moved relative to the hollow shank when being rotated, a hole centrally defined in the adjuster, a first cone centrally extending from a bottom of the hole for selectively closing the first tapered hole, a skirt extending from the bottom of the hole and surrounding the first cone to define an annular groove, multiple channels defined in a bottom of the annular groove and communicating with a recess that is defined in a bottom of the adjuster, the adjuster having multiple ears outwardly extending therefrom, each ear engaged with a corresponding one of the multiple series of indentations;

a holder extending through the positioning ring and longitudinally mounted to the adjuster, a through hole centrally defined in the holder; and a dispensing element extending through the through hole in the holder and mounted on the holder for dispensing the liquid from the hollow shank;

a control device longitudinally mounted to the second end of the hollow shank for allowing the air flow into the hollow shank step by step and the dispensing element outputting the liquid when the air flows into the hollow shank; and a sheath longitudinally mounted to the first end of the hollow shank for protecting the dispensing device after use, the sheath having a hollow rod extending therefrom along an axis thereof for receiving the dispensing element, a free end of the hollow rod of the sheath longitudinally pushing the holder with the adjuster for forcing the first cone to close the first tapered hole when mounting the sheath.

2. The liquid dispenser as claimed in claim 1, wherein the hollow shank including a protrusion co-axially extending from the first end thereof and multiple cutouts defined in the periphery of the protrusion, the cutouts equally dividing the periphery of the protrusion and each partially receiving a corresponding one of the multiple ribs of the positioning ring such that the positioning ring is not rotatable relative to the hollow shank.

3. The liquid dispenser as claimed in claim 2, wherein the hollow shank includes a hollow stub co-axially extending from the protrusion and a V-shaped groove defined in the protrusion within the hollow stub and surrounding the first tapered hole, the hollow stub of the hollow shank rotatably and movably received in the hole in the adjuster for stably operating the adjuster.

4. The liquid dispenser as claimed in claim 1, wherein the control device includes:

a guider co-axially and detachably mounted to the second end of the hollow shank, and airtightly closing the second end of the hollow shank, the guider including a protrusion centrally extending therefrom opposite to the hollow shank and a recess is centrally defined in the protrusion of the guider, a second tapered hole centrally defined in a bottom of the recess in the guider and communicating with the inner periphery of the hollow shank, multiple guide rods perpendicularly extending from the protrusion of the guider;

a drive ring rotatably mounted to the guider, a first ratchet ring inward and radially extending from an inner periphery of the drive ring and surrounding the protrusion of the guider;

a pusher longitudinally mounted to the guider and reciprocally moved relative to the guider, the pusher having a disk co-axially received in the drive ring and the drive ring being rotatable relative to the disk, a block centrally extending from the disk and movably received in the recess in the guider, a second cone centrally extending from the block of the pusher and selectively received in the second tapered hole for closing the second tapered hole, the disk including multiple through holes defined therein for allowing the multiple guide rods extending through the disk, a second ratchet ring formed on the disk and complementally engaged to the first ratchet ring;

a cover secured to a free end of each of the multiple guide rods to prevent the pusher and the drive ring from detaching from the guider; and a resilient member pre-compressively mounted between the disk and the cover to ensure that the first ratchet ring and the second ratchet ring are complementally engaged with each other and the second cone is received in the second tapered hole for closing the second tapered hole before the drive ring being rotated.

5. The liquid dispenser as claimed in claim 4, wherein the guider includes a third tapered hole defined therein and longitudinally communicating with the second tapered hole to define a sandglass-shaped passage in the guider, a hollow protrusion extending from the guider and surrounding the third tapered hole, a distal end of the hollow protrusion slightly and inwardly shrunk, multiple slots longitudinally defined in the hollow protrusion and communicating with an inner periphery of the hollow protrusion, a steel movably received in the hollow protrusion for selectively closing the third tapered hole, the steel ball having a diameter greater than an inner diameter of the distal end of the hollow protrusion to prevent the steel ball from detaching from the hollow protrusion.

6. The liquid dispenser as claimed in claim 5, wherein the drive ring has an annular groove defined in one end thereof for receiving the cover.

7. The liquid dispenser as claimed in claim 6, wherein the cover has multiple hollow stubs extending therefrom, each hollow stub of the cover receiving a free end of a corresponding one of the multiple guide rods.

8. The liquid dispenser as claimed in claim 5, wherein the cover has multiple hollow stubs extending therefrom, each hollow stub of the cover receiving a free end of a corresponding one of the multiple guide rods.

9. The liquid dispenser as claimed in claim 4, wherein the drive ring has an annular groove defined in one end thereof for receiving the cover.

10. The liquid dispenser as claimed in claim 4, wherein the cover has multiple hollow stubs extending therefrom, each hollow stub of the cover receiving a free end of a corresponding one of the multiple guide rods.

11. A liquid dispenser comprising:

a hollow shank having a closed first end and a second open second end, a first tapered hole centrally defined in the first end of the hollow shank and communicating with an inner periphery of the hollow shank, a first skirt co-axially extending from the first end of the hollow shank, the first skirt including a first annular hook inward formed on a free end thereof and multiple slots longitudinally defined therein;

a dispensing device longitudinally mounted to the first end of the hollow shank, the dispensing device including:

a holder engaged to the first skirt and reciprocally moved relative to the first end of the hollow shank, a second annular hook outwardly extending from a first end of the holder and engaged to the first annular hook to prevent the holder from detaching from the hollow shank, a receiving centrally defined in the holder, a first shoulder and a second shoulder sequentially and centrally formed on a bottom of the receiving space, wherein the first shoulder has a diameter greater than that of the second shoulder, a through hole centrally defined in a second end of the holder;

a dispensing element extending through the through hole in the holder and mounted in the second end of the holder for dispensing liquid from the hollow shank; and a dispensing block received in the holder and mounted on the second shoulder, the dispensing block having a first cone centrally extending therefrom for selectively closing the first tapered hole, an annular groove defined in the dispensing block and surrounding the first cone, multiple channels defined in a bottom of the annular groove and communicating with the through hole in the holder;

a control device mounted to the second end of the hollow shank for allowing the air flow into the hollow shank step by step and the dispensing element outputting the liquid when the air flows into the hollow shank; and a sheath longitudinally mounted to the first end of the hollow shank for protecting the dispensing device after use, the sheath having a hollow rod extending therefrom along an axis thereof for receiving the dispensing element, a free end of the hollow rod of the sheath longitudinally pushing the holder with the dispensing block for forcing the first cone to close the first tapered hole when mounting the sheath.

12. The liquid dispenser as claimed in claim 11, wherein the hollow shank includes a second skirt co-axially extending from a first end thereof within the first skirt and surrounding the first tapered hole, a V-shaped groove defined in the in the first end of the hollow shank for containing the remained liquid in the dispensing device when the hollow shank is reversed, the second skirt movably received in the receiving space for promoting the steadiness when the holder is moved relative to the hollow shank.

13. The liquid dispenser as claimed in claim 11, wherein the control device includes:

a guider co-axially mounted to the second end of the hollow shank for airtightly closing the second end of the hollow shank, the guider having a protrusion centrally extending therefrom opposite to the hollow shank, a recess centrally defined in the protrusion and a second tapered hole centrally defined in a bottom of the recess, multiple guide rods perpendicularly extending from the protrusion of the guider;

an actuator rotatably mounted on the guider, the actuator including a central hole defined therein for receiving the protrusion of the guider, the actuator including an outer ratchet ring and an inner ratchet ring respectively formed on one side thereof opposite to the guider, wherein the ratchet direction of the outer ratchet ring is opposite to that of the inner ratchet ring;

a pusher longitudinally mounted to the actuator and reciprocally movably relative to the guider, the pusher having a disk rotatably and partially received in the actuator, a block centrally extending from the disk and rotatably received in the recess in the guider, a second cone centrally extending from the block and selectively received in the second tapered hole for closing the second tapered hole, the disk having multiple through hole defined therein for allowing the multiple guide rods extending through the pusher, a first ratchet ring formed on one side of the disk and complementally engaged with the inner ratchet ring;

a drive element co-axially mounted to the actuator and reciprocally movably relative to the actuator, the drive element including a cylindrical portion having a diameter equal to that of the outer ratchet ring, the cylindrical portion having a closed end and an open end, a second ratchet ring formed on a distal edge of the open end of the cylindrical portion, wherein the second ratchet ring is overlapped relative to the outer ratchet ring and complementally corresponds to the outer ratchet ring, and the second ratchet ring is separated from the outer ratchet ring when the drive element is in a free condition, the drive element having multiple through holes defined in the closed end of the cylindrical portion to allow the multiple guide rods extending through the drive element, a hollow rod co-axially extending from the closed end of the cylindrical portion;

a resilient pre-compressed and mounted between the pusher and the drive element to make the second ratchet being separated from the outer ratchet ring and the first ratchet engaged with the inner ratchet ring when the drive element is in a free condition; and a cap co-axially and securely mounted to the guider for movably receiving the drive element, the cap has a through hole defined therein for allowing the hollow rod of the drive element extending through the cap.

14. The liquid dispenser as claimed in claim 13, wherein the guider has a third tapered hole defined therein and longitudinally communicating with the second tapered hole, a hollow protrusion extending from the guider and surrounding the third tapered hole, a distal end of the hollow protrusion is slightly and inwardly shrunk, multiple slots longitudinally defined in the hollow protrusion and communicating with an inner periphery of the hollow protrusion, a steel ball movably received in the hollow protrusion for closing the third tapered hole when the hollow shank is reversed, the steel ball having a diameter greater than an inner diameter of the distal end of the hollow protrusion to prevent the steel ball from detaching from the hollow protrusion.

15. The liquid dispenser as claimed in claim 14, wherein the guider includes a passage longitudinally defined therein, the passage having two opposite ends respectively communicating with the second tapered hole and the third tapered hole, a heel longitudinally extending from a top of the second cone and selectively received in the passage for blocking the passage.

16. The liquid dispenser as claimed in claim 14, wherein the cap includes an annular groove defined therein and surrounding the through hole in the cap, a free end of each of the multiple guide rods received in the annular groove in the cap when the cap is mounted to the guider.

17. The liquid dispenser as claimed in claim 13, wherein the guider includes a passage longitudinally defined therein, the passage having two opposite ends respectively communicating with the second tapered hole and the third tapered hole, a heel longitudinally extending from a top of the second cone and selectively received in the passage for blocking the passage.

18. The liquid dispenser as claimed in claim 17, wherein the cap includes an annular groove defined therein and surrounding the through hole in the cap, a free end of each of the multiple guide rods received in the annular groove in the cap when the cap is mounted to the guider.

19. The liquid dispenser as claimed in claim 18, wherein the guider has a third tapered hole defined therein and longitudinally communicating with the second tapered hole, a hollow protrusion extending from the guider and surrounding the third tapered hole, a distal end of the hollow protrusion is slightly and inwardly shrunk, multiple slots longitudinally defined in the hollow protrusion and communicating with an inner periphery of the hollow protrusion, a steel ball movably received in the hollow protrusion for closing the third tapered hole when the hollow shank is reversed, the steel ball having a diameter greater than an inner diameter of the distal end of the hollow protrusion to prevent the steel ball from detaching from the hollow protrusion.

20. The liquid dispenser as claimed in claim 13, wherein the cap includes an annular groove defined therein and surrounding the through hole in the cap, a free end of each of the multiple guide rods received in the annular groove in the cap when the cap is mounted to the guider.

* * * * *